US006649252B2

(12) United States Patent
Romano, Jr. et al.

(10) Patent No.: US 6,649,252 B2
(45) **Date of Patent: *Nov. 18, 2003**

(54) INK JET RECORDING ELEMENT

(75) Inventors: Charles E. Romano, Jr., Rochester, NY (US); Sandra D. Nesbitt, Rochester, NY (US); Lawrence P. DeMejo, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 119 days.

This patent is subject to a terminal disclaimer.

(21) Appl. No.: 09/742,752

(22) Filed: Dec. 20, 2000

(65) Prior Publication Data

US 2002/0115015 A1 Aug. 22, 2002

(51) Int. Cl.[7] ..... B41M 5/00
(52) U.S. Cl. ..... 428/205; 428/204; 428/32.1
(58) Field of Search ..... 428/195, 204, 428/205, 32.1, 195.1

(56) References Cited

U.S. PATENT DOCUMENTS 5,958,601 A 9/1999 Salsman
6,087,051 A 7/2000 Shoji et al.

FOREIGN PATENT DOCUMENTS

| | | | | |
|---|---|---|---|---|
| EP | 0 958 921 A2 | | 11/1999 | |
| EP | 0 958 922 A2 | | 11/1999 | |
| JP | 08174989 A | * | 7/1996 | ..... B41M/05/00 |
| JP | 2000335043 A | * | 12/2000 | ..... B41J/29/00 |

* cited by examiner

*Primary Examiner*—Pamela R. Schwartz
(74) *Attorney, Agent, or Firm*—Harold E. Cole

(57) ABSTRACT

An ink jet recording element comprising a support having thereon an image-receiving layer containing an ink jet image and an overcoat layer of a water-dispersible, hydrophobic polyester resin having the following general formula:

$$I_n—P—A_m$$

wherein

I is an ionic group;

n is an integer from 1–3;

P is a polyester backbone;

A is an aliphatic group comprising a straight or branched chain fatty acid or triglyceride thereof having from about 6 to about 24 carbon atoms; and m is an integer from 3–8.

8 Claims, No Drawings

INK JET RECORDING ELEMENT

CROSS REFERENCE TO RELATED APPLICATIONS

Reference is made to commonly-assigned copending U.S. patent application Ser. No. 08/742,525, filed of even date herewith, entitled "Process for Laminating Ink Jet Print", of Romano, Jr., et al; and U.S. patent application Ser. No. 09/742,982, filed of even date herewith, entitled "Ink Jet Printing Process", of Romano, Jr., et al.

FIELD OF THE INVENTION

This invention relates to an ink jet recording element for improving the durability of an ink jet image.

BACKGROUND OF THE INVENTION

Ink jet printing is a non-impact method for producing images by the deposition of ink droplets in a pixel-by-pixel manner to an image-recording element in response to digital signals. There are various methods which may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to an ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation. Ink jet printers have found broad applications across markets ranging from industrial labeling to short run printing to desktop document and pictorial imaging.

The inks used in the various ink jet printers can be classified as either dye-based or pigment-based. A dye is a colorant which is molecularly dispersed or solvated by a carrier medium. The carrier medium can be a liquid or a solid at room temperature. A commonly used carrier medium is water or a mixture of water and organic co-solvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor light-fastness. When water is used as the carrier medium, such inks also generally suffer from poor water-fastness.

DESCRIPTION OF RELATED ART

U.S. Pat. No. 6,087,051 relates to an ink jet recording element containing a protective overcoat layer of an aqueous polyurethane resin or an aqueous polyacryl resin. In addition, there are comparison examples in that patent which use a polyester resin, and the aqueous polyurethane resin and polyacryl resins are said to have advantages over the polyester resin. However, there are problems using a polyurethane resin or an aqueous polyacryl resin in that these resins have to be synthesized from virgin raw materials and the resins cannot be recycled.

It is an object of this invention to provide an ink jet recording element which has an ink jet image with improved durability. It is another object of this invention to provide an ink jet recording element containing an overcoat layer made with a material that can be made from recycled materials and is capable of being recycled.

SUMMARY OF THE INVENTION

These and other objects are achieved in accordance with the present invention which comprises an ink jet recording element comprising a support having thereon an image-receiving layer containing an ink jet image and an overcoat layer of a water-dispersible, hydrophobic polyester resin having the following general formula:

$$I_n—P—A_m$$

wherein

I is an ionic group;

n is an integer from 1–3;

P is a polyester backbone;

A is an aliphatic group comprising a straight or branched chain fatty acid or triglyceride thereof having from about 6 to about 24 carbon atoms; and m is an integer from 3–8.

It was found that the durability of an ink jet image is improved using an overcoat layer of a material that is capable of being recycled.

DETAILED DESCRIPTION OF THE INVENTION

The ionic groups I in the above formula which provide the polymer with water-dispersibility are typically derived from a carboxylic acid group which is introduced into the resin by polyacid monomers such as trimellitic anhydride, trimellitic acid, or maleic anhydride or sulfonate groups which come from monomers such as dimethyl 5-sulfoisophthalate, dimethyl 5-sulfo,1,3-benzenedicarboxylate, sulfoisophthalate ethylene glycol, dihydroxyethyl-5-sulfol, 3-benzenedicarboxylate, or from sulfonated alkenically unsaturated end groups as described in U.S. Pat. No. 5,281,630, the disclosure of which is hereby incorporated by reference. The weight percent of ionic monomers in the resin is from 1% to 20%, but 1% to 10% is preferred.

The backbone P of the polymer in the above formula is composed of polyester groups. It can be any linear or branched polyester made using polyacids and polyalcohols. The weight percent of the polyester backbone ingredients range from 30–80% of the whole resin, with the most preferred being 50–60% by weight. Examples of aromatic dicarboxylic acids useful in the backbone polyester polymer, P, employed in the invention include, but are not limited to, terephthalic, isophthalic, phthalic, and 2,6-naphthoic, succinic, glutaric, adipic, 1,4-cyclohexane dicarboxylic, maleic, fumaric, and azelaic. The polyalcohol component of the polyester can be virtually any dihydroxy functional compound. Aliphatic and alicyclic glycols would be the most useful. Useful glycols include, but are not limited to, ethylene glycol, 1,3-propylene glycol, 1,2-propylene glycol, dipropylene glycol, tripropylene glycol, 1,4-butanediol, 1,5-pentanediol, 1,6-hexanediol, cyclohexanedimethanol, diethylene glycol, and triethylene glycol.

The backbone polyester consisting of any combination of the above polyacids and glycols may further directly include or incorporate by transesterification a multifunctional polyol selected from, but not limited to, glycerol, trimethylolpropane, erythritol, pentaerythritol, trimethylolethane, or a monosaccharide.

As noted above, A in the above formula is an aliphatic group comprising a straight or branched chain fatty acid or triglyceride thereof having from about 6 to about 24 carbon atoms, such as stearic, oleic, palmitic, lauric, linoleic, linolenic, behenic acid, or their mixtures. These can come from hydrogenated or unhydrogenated animal or vegetable oil, such as beef tallow, lard, corn oil, or soy bean oil. The weight percent of the aliphatic moiety can be 10–60%, with 20–40% by weight being the preferred amount.

In a preferred embodiment of the invention, the water-dispersible, hydrophobic polyester resin employed comprises a reaction product of 30–70% by weight of a poly (ethylene terephthalate) condensation polymer; 5–40% by weight of a hydroxy functional compound having at least two hydroxyl groups; 1–20% by weight of a carboxy functional compound having at least two carboxyl groups and 10–60% by weight of a $C_6$–$C_{24}$ straight chain or branched fatty acid or triglyceride. The resin is further characterized in that the hydroxy functional compound is present at 1–3 times the equivalents of the hydrophobic moiety. The preparation of such hydrophobic polyester resins is described in detail in U.S. Pat. No. 5,958,601, the disclosure of which is hereby incorporated by reference. In another preferred embodiment, the water-dispersible, hydrophobic polyester resin comprises water-dispersed transesterified polyester, e.g., poly(ethylene terephthalate) transesterified in the presence of stearic acid and trimellitic acid, or oleic acid and trimellitic acid.

In another preferred embodiment of the invention, the water-dispersible, hydrophobic polyester as described above is physically mixed with a thermoplastic or thermosetting polymer. The thermoplastic or thermosetting polymer lends added hydrophobicity to the layer, as well as enhanced coating flexibility and serves as a diluent to the polyester component to minimize cross-linking which would deleteriously alter coating properties.

Examples of such thermoplastic or thermosetting polymers useful in the invention include, but are not limited to, carboxylated styrene butadiene, styrene/acrylate or methacrylate ester compositions containing acrylic or methacrylic acids, hydrolyzed styrene maleic anhydride copolymers, styrene maleic acid salt copolymers, styrene maleic ester copolymers, styrene (meth)acrylate copolymers, styrene (meth)acrylate ester copolymers, styrene acrylate ester acrylonitrile terpolymers, acrylonitrile (meth)acrylate salt copolymers, polycarbonate-based polyurethanes, polyester-based polyurethanes, cellulose polymers, such as methyl cellulose and cellulose acetate butyrate, polyesters, polyamides, polyacetals, epoxy polymers, phenoxy polymers, etc. In a preferred embodiment, the water-dispersible, hydrophobic polyester resin and thermoplastic or thermosetting polymer is present in a ratio from about 1:4 to 4:1.

A preferred aqueous dispersion of a mixture of carboxylated styrene butadiene copolymer and a hydrophobic polyester of the composition generally described above is commercially available as EvCote® PWRHS-37 from EvCo Research Incorporated, Atlanta, Ga., USA.

In another preferred embodiment, the overcoat layer may also contain a synthetic or natural wax, such as an aqueous dispersion of high density polyethylene, Jon Wax 26® (S. C. Johnson Co.) or an aqueous dispersion of carnauba wax (Michelman Co.); and/or a microgel, such as a microgel of methyl methacrylate/ethylene glycol dimethacrylate/acrylic acid.

Ink jet inks used to prepare the images to be protected using the invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Any known ink jet image-receiving layer can be used in the present invention. For example, the image-receiving layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like; derivatives of natural polymers such as functionalized proteins, functionalized gums and starches, and cellulose ethers and their derivatives; and synthetic polymers such as polyvinyloxazoline, polyvinylmethyloxazoline, polyoxides, polyethers, poly(ethylene imine), poly(acrylic acid), poly (methacrylic acid), n-vinyl amides including polyacrylamide and polyvinylpyrrolidone, and poly(vinyl alcohol), its derivatives and copolymers; and combinations of these materials. Hydrophilic polymers, inorganic oxide particles, and organic beads may be present in one or more layers on the substrate and in various combinations within a layer.

A porous structure may be introduced into image-receiving layers comprised of hydrophilic polymers by the addition of ceramic or hard polymeric particulates, by foaming or blowing during coating, or by inducing phase separation in the layer through introduction of nonsolvent.

In practice, various additives may be employed in the image-receiving layer and overcoat. These additives include surface active agents surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the image-receiving layer and the overcoat layer, may be coated by conventional coating means onto a transparent or opaque support material commonly used in this art. Coating methods may include, but are not limited to, wound wire rod coating, slot coating, slide hopper coating, gravure, curtain coating, and the like. Some of these methods allow for simultaneous coatings of both layers, which is preferred from a manufacturing economic perspective.

The image-receiving layer may be present in any amount which is effective for the intended purpose. In general, good results are obtained when it is present in an amount of from about 5 to about 30 $g/m^2$, preferably from about 8 to about 15 $g/m^2$, which corresponds to a dry thickness of about 5 to about 30 $\mu$m, preferably about 8 to about 15 $\mu$m.

The overcoat layer may be applied to the ink jet image in accordance with the invention either through a separate thermal or piezoelectric printhead, or by any other method which would apply the material evenly to the image, such as a spray bar. Methods of applying a overcoat layer are disclosed in commonly-owned U.S. patent application Ser. No. 09/083,673 filed May 22, 1998, entitled "Printing Apparatus With Spray Bar For Improved Durability" of Wen et al. and U.S. patent application Ser. No. 09/083,876, filed May 22, 1998, entitled "Ink Jet Printing Apparatus With Print Head For Improved Image Quality" of Wen et al., the disclosures of which are incorporated herein by reference. Other methods for applying the overcoat layer include submerging the element into a tank containing a liquid dispersion of the polyester or by extrusion of the polyester on top of the recording element.

In general, the overcoat layer may be present at a dry thickness of from about 0.1 to about 5 $\mu$m, preferably from about 0.25 to about 3 $\mu$m.

The support for the ink jet recording element used in the invention can be any of those usually used for ink jet receivers, such as paper, resin-coated paper, poly(ethylene terephthalate), poly(ethylene naphthalate) and microporous materials such as poly polyethylene polymer-containing material sold by PPG Industries, Inc., Pittsburgh, Pennsylvania under the trade name of Teslin ®, Tyvek ® synthetic paper (DuPont Corp.), and OPPalyte® films (Mobil Chemical Co.) and other composite films listed in U.S. Pat. No. 5,244,861.

The support used in the invention may have a thickness of from about 50 to about 500 μm, preferably from about 75 to 300 μm. Antioxidants, antistatic agents, plasticizers and other known additives may be incorporated into the support, if desired. In a preferred embodiment, either paper or poly(ethylene terephthalate) is employed.

In order to improve the adhesion of the image-receiving layer to the support, the surface of the support may be subjected to a corona-discharge-treatment prior to applying the image-receiving layer.

In addition, a subbing layer, such as a layer formed from a halogenated phenol or a partially hydrolyzed vinyl chloride-vinyl acetate copolymer can be applied to the surface of the support to increase adhesion of the image-receiving layer. If a subbing layer is used, it should have a thickness (i.e., a dry coat thickness) of less than about 2 μm.

The following examples are provided to illustrate the invention.

EXAMPLES

Example 1

Control Elements C-1 and C-2

Various color patches were printed onto a receiver of Eastman Kodak Transparency Cat. No. 110 5725 at various densities using a Hewlett-Packard PhotoSmart® Printer and Hewlett-Packard Cartridges C3844A and C3845A containing colored and black dye-based inks. Control element C-1 was printed which did not have an overcoat layer. Control element C-2 had an overcoat of a non-modified polyester composed of isophthalic acid, diethylene glycol and a sulfo-derivative of dicarboxylic acid, Eastman Chemical Co. WD-SIZE® (U.S. Pat. No. 6,087,051, col. 21), at 11 μm. The element was overcoated using a computer-driven extrusion coating device.

Element 1 of the Invention

This element was prepared the same as Control C-2, except that the overcoat layer was:

OC-1 EvCo Research Inc. PWRH-25, Poly(ethylene terephthalate), (PET) transesterified in the presence of stearic acid and trimellitic acid.

Element 2 of the Invention

This element was prepared the same as Control C-2, except that the overcoat layer was:

OC-2 EvCo Research Inc. PWRH-37, PET transesterified in the presence of stearic acid and trimellitic acid and which contains carboxylated styrene-butadiene, (1:1 wt. ratio).

Control Element C-3

This element was prepared the same as C-1 except that the receiver was Konica QP Photo Quality Ink Jet Paper.

Control Element C-4

This element was prepared the same as C-2 except that the receiver was Konica QP Photo Quality Ink Jet Paper and the overcoat layer was 5 μm thick.

Control Element C-5

This element was prepared the same as C-2 except that the receiver was Konica QP Photo Quality Ink Jet Paper and the overcoat layer was 7.5 μm thick.

Element 3 of the Invention

This element was prepared the same as Control C-5, except that the overcoat layer was OC-1 EvCo Research Inc. PWRH-25.

Element 4 of the Invention

This element was prepared the same as Control C-5, except that the overcoat layer was OC-3 EvCo Research Inc. PGLR-25, transesterified PET.

Element 5 of the Invention

This element was prepared the same as Control C-5, except that the overcoat layer was OC-4 EvCo PWRHS-37, PET transesterified in the presence of stearic acid and trimellitic acid and which contains carboxylated styrene-butadiene, (1:1 wt. ratio), a microgel of methyl methacrylate/ethylene glycol dimethacrylate/acrylic acid (80:10:10 wt. ratio), an aqueous dispersion of high density polyethylene, Jon Wax 26® (S. C. Johnson Co.) and an aqueous dispersion of carnauba wax (Michelman Co.), (73.4:23:1.8:1.8 wt. ratio).

Element 7 of the Invention

This element was prepared the same as Control C-5, except that the overcoat layer was OC-6 EvCo Research Inc. PWRH-25, PET transesterified in the presence of stearic acid and trimellitic acid and a microgel of methyl methacrylate/ethylene glycol dimethacrylate/acrylic acid (80:10:10 wt. ratio), an aqueous dispersion of high density polyethylene, Jon Wax 26® (S. C. Johnson Co.) and an aqueous dispersion of carnauba wax (Michelman Co.), (73.4:23:1.8:1.8 wt. ratio).

Element 6 of the Invention

This element was prepared the same as Control C-4, except that the overcoat layer was OC-5 EvCo Research Inc. PWRH-25, PET transesterified in the presence of stearic acid and trimellitic acid and a polyurethane based on a polycarbonate polyol, bishydroxymethylol propionic acid, bisphenol-A and isophorone-diisocyanate (Eastman Kodak Co.) (1:1 wt. ratio).

After printing, the receivers were placed in an oven at 60° C. for 5 minutes to ensure proper drying of the ink.

Water and Stain Resistance Test

Drops of water, coffee, fruit punch and mustard were then placed on printed and non-printed areas of the elements. The water drops and stain materials were allowed to penetrate for one hour and then blotted off using a lint-free cloth. A damp cloth was the used to gently wipe any stain remaining on the print. The sample was then evaluated by visually inspecting for staining, surface damage, dye loss, density loss, cracking or any other visible defect. The following ratings were used for the evaluation:

1=No change

2=Surface damage

3=Slight stain or color change

4=Significant stain or color change

The values for the stains were averaged together. The following results were obtained:

TABLE 1

| Element | Receiver | Overcoat (μm) | Water Resistance | Stain Resistance |
|---|---|---|---|---|
| C-1 | A | None | 4 | 4 |
| C-2 | A | WD Size (11) | * | * |
| 1 | A | OC-1 (11) | 3 | 2.3 |
| 2 | A | OC-2 (11) | 3 | 2 |
| C-3 | B | None | 4 | 4 |
| C-4 | B | WD Size (5) | 2 | 3 |
| C-5 | B | WD Size (7.5) | 2 | 3 |
| 3 | B | OC-1 (7.5) | 1 | 1.3 |

TABLE 1-continued

| Element | Receiver | Overcoat (μm) | Water Resistance | Stain Resistance |
|---|---|---|---|---|
| 4 | B | OC-3 (7.5) | 3 | 1.7 |
| 5 | B | OC-4 (7.5) | 1 | 1 |
| 6 | B | OC-5 (5) | 1 | 1 |
| 7 | B | OC-6 (7.5) | 2 | 1 |

* Coating repelled and did not coat

The above results show that the elements employed in the process of the invention had better water and stain resistance than the control elements.

Example 2

Control Element C-6

This element was prepared the same as C-1 except that the receiver was Epson Premium Glossy Photo Paper Cat. No. SO41286.

Control Element C-7

This element was prepared the same as C-2 except that the receiver was Epson Premium Glossy Photo Paper Cat. No. SO41286 and the overcoat layer was 2.5 μm thick.

Control Element C-8

This element was prepared the same as C-2 except that the receiver was Epson Premium Glossy Photo Paper Cat. No. SO41286 and the overcoat layer was 3.5 μm thick.

Element 8 of the Invention

This element was prepared the same as Control C-7, except that the overcoat layer was OC-1 EvCo Research Inc. PWRH-25.

Element 9 of the Invention

This element was prepared the same as Control C-8, except that the overcoat layer was OC-2 EvCo Research Inc. PWRH-37.

These elements were printed and evaluated the same as in Example 1 with the following results:

TABLE 2

| Element | Receiver | Overcoat (μm) | Water Resistance | Stain Resistance |
|---|---|---|---|---|
| C-6 | C | None | 2 | 4 |
| C-7 | C | WD Size (2.5) | 2 | 3 |
| C-8 | C | WD Size (3.5) | 2 | 3 |
| 8 | C | OC-1 (2.5) | 1 | 1.3 |
| 9 | C | OC-2 (3.5) | 2 | 1.3 |

The above results show that the elements employed in the invention had better water and stain resistance than the control elements.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a support having thereon an image-receiving layer containing an ink jet image and an overcoat layer that contains a synthetic or natural wax and/or a microgel and also a water-dispersible, hydrophobic polyester resin having the following general formula:

$$I_n—P—A_m$$

wherein

I is an ionic group;

n is an integer from 1–3;

P is a polyester backbone;

A is an aliphatic group comprising a straight or branched chain fatty acid or triglyecride thereof having from about 6 to about 24 carbon atoms; and m is an integer from 3–8.

2. The element of claim 1 wherein said support is paper.

3. The element of claim 1 wherein said support is poly (ethylene terephthalate).

4. The element of claim 1 wherein said overcoat layer contains said water-dispersible, hydrophobic polyester resin and a thermoplastic or thermosetting polymer.

5. The element of claim 4 wherein said water-dispersible, hydrophobic polyester resin and said thermoplastic or thermosetting polymer is present in ratio of from about 1:4 to about 4:1.

6. The element of claim 5 wherein said thermoplastic or thermosetting polymer comprises a copolymer of styrene and butadiene.

7. The element of claim 1 wherein said water-dispersible, hydrophobic polyester resin comprises water-dispersed transesterified polyester.

8. The element of claim 7 wherein said overcoat layer also contains a synthetic or natural wax and/or a microgel.

* * * * *